US007993072B2

(12) United States Patent
Lill

(10) Patent No.: US 7,993,072 B2
(45) Date of Patent: Aug. 9, 2011

(54) RESTRICTOR PLATE WITH SECURING SYSTEM

(75) Inventor: Clifford F. Lill, Hawthorne, NJ (US)

(73) Assignee: Campbell-ERS L.L.C., Harrison, NJ (US)

( * ) Notice: Subject to any disclaimer, the term of this patent is extended or adjusted under 35 U.S.C. 154(b) by 92 days.

(21) Appl. No.: 12/610,622

(22) Filed: Nov. 2, 2009

(65) Prior Publication Data

US 2011/0100886 A1 May 5, 2011

(51) Int. Cl.
*E01C 11/22* (2006.01)

(52) U.S. Cl. ..... 404/4; 404/2; 210/163

(58) Field of Classification Search ..... 404/2–4, 404/7, 8; 405/36; 210/163
See application file for complete search history.

(56) References Cited

U.S. PATENT DOCUMENTS

| | | | | |
|---|---|---|---|---|
| 4,594,157 | A * | 6/1986 | McGowan | 210/163 |
| 6,017,166 | A * | 1/2000 | Mossburg, Jr. | 404/5 |
| 7,160,048 | B1 * | 1/2007 | Fattori et al. | 404/4 |
| 7,179,371 | B1 * | 2/2007 | Bistline | 210/163 |

* cited by examiner

*Primary Examiner* — Raymond W Addie
(74) *Attorney, Agent, or Firm* — Day Pitney LLP

(57) ABSTRACT

A restrictor plate assembly is disclosed. The assembly is adapted for being positioned within a catch basin throat so that the throat extends rearward of the assembly. The assembly has a longitudinally extending restrictor plate and a restrictor plate securing system, which includes a first clamp arm, pivotally positioned against the restrictor plate, for engaging a first throat surface of the catch basin; a second clamp arm pivotally positioned against the restrictor plate, for engaging a second throat surface of the catch basin, the second throat surface opposing the first throat surface; and an urging member which simultaneously urges the first and second clamp arms against the first and second throat surfaces, respectively.

28 Claims, 7 Drawing Sheets

RESTRICTOR PLATE WITH SECURING SYSTEM

BACKGROUND OF THE DISCLOSURE

1. Field of the Disclosure

The invention relates to a system for positioning a restrictor plate within a catch basin throat.

2. Background of the Related Art

Private groups and government bodies, such as the United States Environmental Protection Agency (U.S.E.P.A.), have sought to control unregulated sources of storm water discharge that have the greatest likelihood of causing continued environmental degradation. Such sources include storm water runoff, which picks up and transports harmful pollutants and discharges them, untreated, to waterways via sewer systems. Sediment-laden, contaminated runoff can overwhelm local water bodies, particularly small streams, resulting in streambed scour, stream bank erosion, and destruction of near-stream vegetative cover. The further result is the loss of in-stream habitats for fish and other aquatic species, an increased difficulty in filtering drinking water, the loss of drinking water reservoir storage capacity, and negative impacts on the navigational capacity of waterways.

Introduced regulations limit the size of runoff access points in storm drains to a maximum of seven square inches. Openings defining such access points must be not more than two inches across the smallest dimension. For example, a rectangular opening of two inches by three and a half inches would conform to such regulations. Such regulations have left state and local governments, who have curbside storm water catch basins with large inlets, searching for a solution.

Accordingly, there is a need to provide a novel structure for enabling drain water and allowable sized sediment to enter the sewer system while preventing the access to larger sediment.

SUMMARY OF THE EMBODIMENTS

A restrictor plate assembly is disclosed. The assembly is adapted for being positioned within a catch basin throat so that the throat extends rearward of the assembly. The assembly has a longitudinally extending restrictor plate and a restrictor plate securing system, which includes a first clamp arm, pivotally positioned against the restrictor plate, for engaging a first throat surface of the catch basin; a second clamp arm pivotally positioned against the restrictor plate, for engaging a second throat surface of the catch basin, the second throat surface opposing the first throat surface; and an urging member which simultaneously urges the first and second clamp arms against the first and second throat surfaces, respectively.

BRIEF DESCRIPTION OF THE FIGURES

It is to be understood that the following drawings depict details of only typical embodiments of the invention and are not therefore to be considered to be limiting of its scope, and in particular.

DETAILED DESCRIPTION OF THE EMBODIMENTS

The Catch Basin

Figure 1:
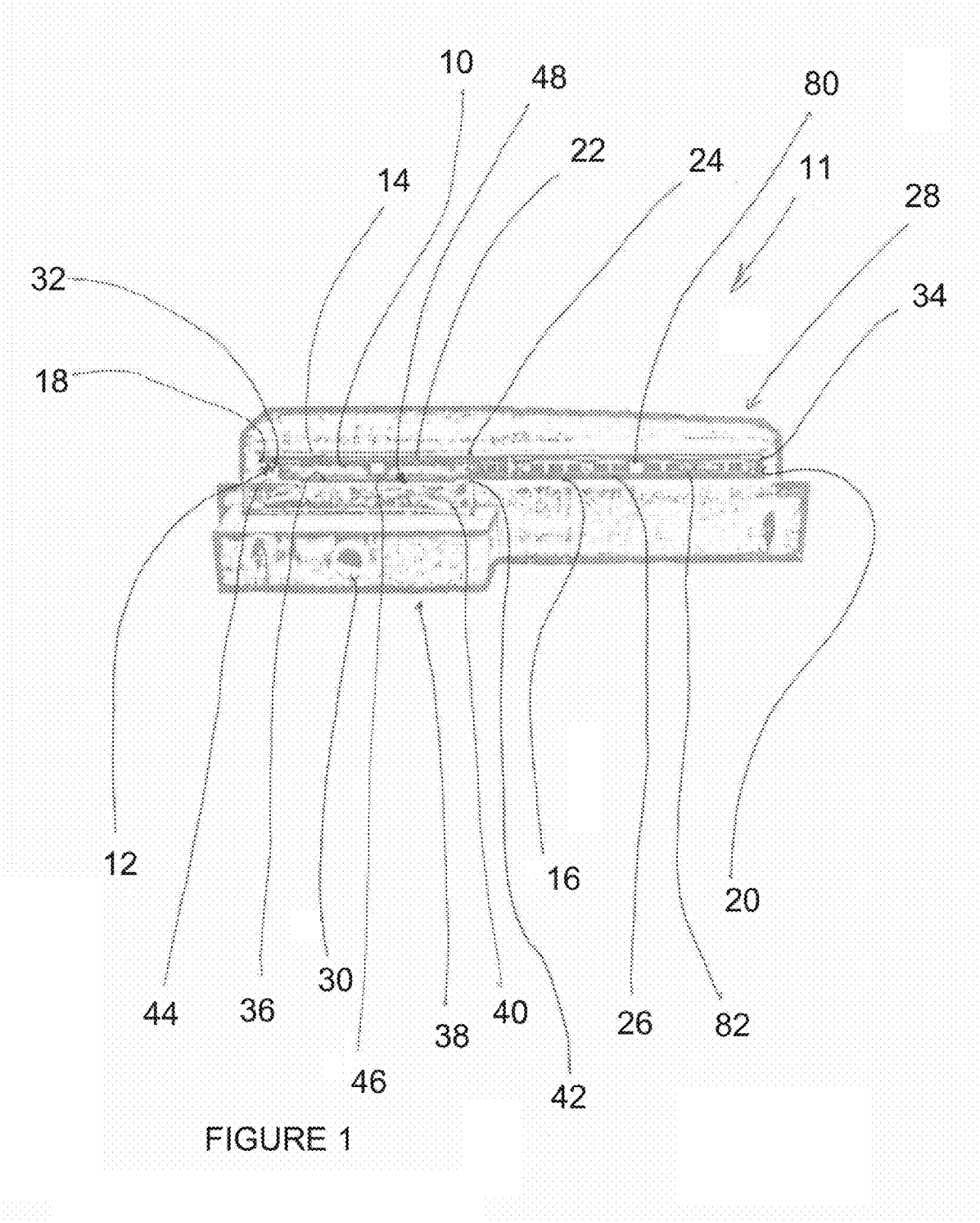
FIG. 1 illustrates a catch basin fitted with a restrictor plate according to an embodiment of the invention.

FIG. 1 is a prospective/front view of a restrictor plate 10, according to an embodiment of the invention, fitted within a Type Five (5) Catch Basin, utilized by the Department of Transportation for the state of Florida, U.S.A. This catch basin 11 is provided herein for illustration purposes only. The catch basin 11 includes a rectangular inlet 12, in which the restrictor plate 10 is positioned. Further details of the catch basin 11 will be disclosed for providing context for the shape and function of the restrictor plate 10.

The catch basin 11, is formed from reinforced concrete and has a rectangular inlet 12. As illustrated, the width is substantially greater than the height. Specifically, the height is about five inches while the width is almost eleven feet.

With further reference to FIG. 1, the height of the inlet 12 is defined by opposing top and bottom edges 14, 16 and the width is defined by opposing side edges 18, 20. The top and side inlet edges are chamfered in the location where the edges lead into the basin throat 22.

Top and bottom throat surfaces 24, 26 extend rearward from top and bottom inlet edges 14, 16, and both pitch downwardly towards the rear 28 of the throat 22. Similarly, opposing side throat surfaces 32, 34 extend reward from opposing side inlet edges 18, 20 and taper inwardly towards the rear of the throat 28.

In the area of the drain 30, the catch basin includes a grate 36. As illustrated, the grate 36 is on one side 38 of the catch basin 11. The grate 36 allows sediment to drop into a basin cavity 40, and pass into the drain 30. Furthermore, the grate 36 is flush with the surface of the basin 11.

The grate has opposing side edges 42, 44 defining a width of the grate 36. The side edges are spaced about five feet from each other. In the illustrated basin 11, this spacing is less than a half of the width of the inlet 12.

On the other hand, the grate 36 has a depth defined by opposing front and rear grate edges 46, 48. The grate front edge 46 is forward of the inlet 12. On the other hand, the grate rear edge 48 is rearward of the inlet 12. In the illustrated basin 11, the grate rear edge 48 is about a half a foot rear of the basin inlet 12.

The Restrictor Plate

Figure 2:
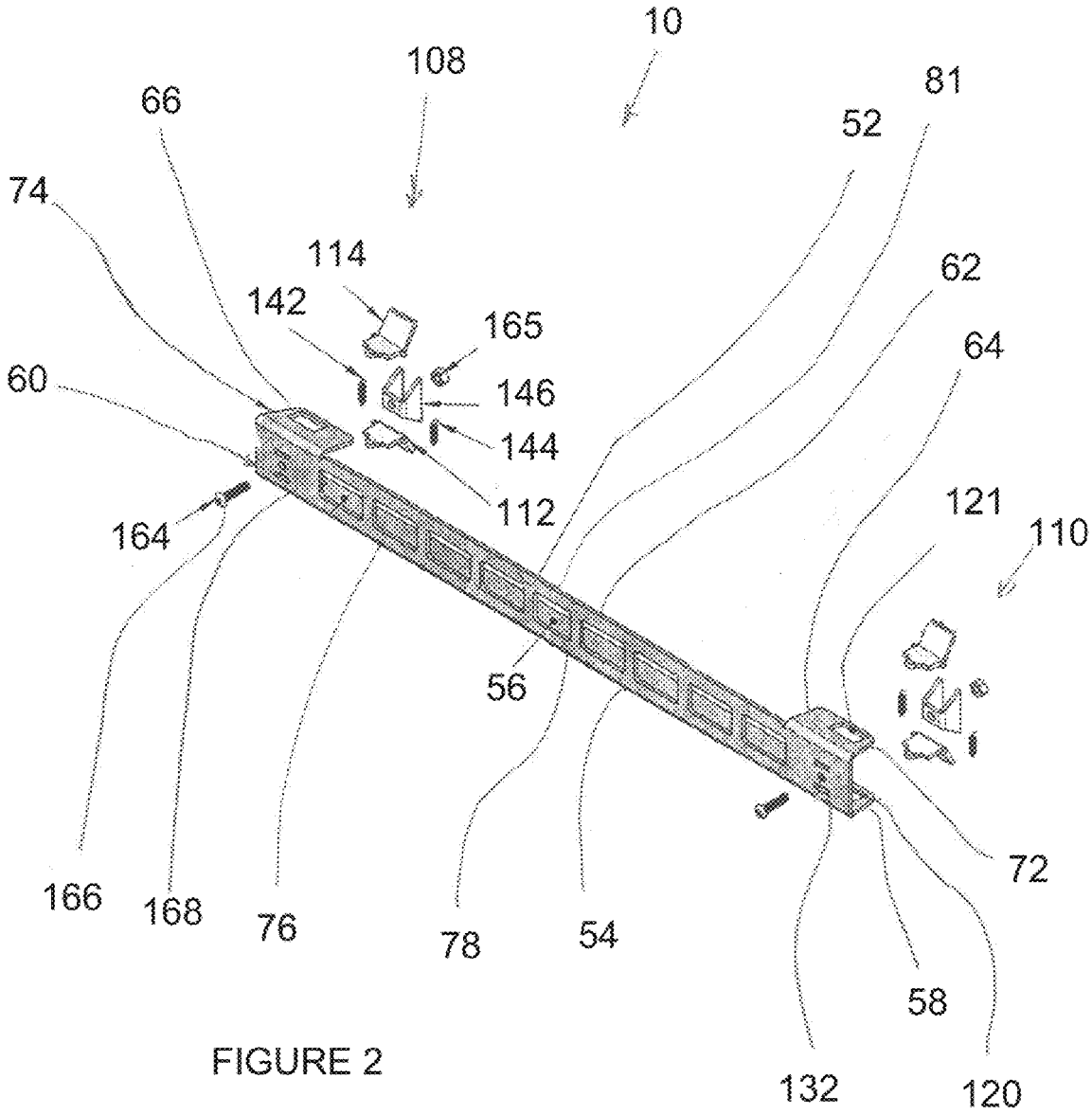
FIG. 2 illustrates details of a restrictor plate provided in FIG. 1.

Turning to FIG. 2 the restrictor plate 10 is illustrated. The restrictor plate 10 is adapted for being retrofitted into the basin throat 22, flush with or rear of the inlet 12. The restrictor plate 10 can be manufactured from an appropriately rigid and durable material. One example is strength/low alloy, quarter-inch thick, Cor-Ten brand weathering steel, which is an ASTM A588 grade steel rated to 60,000 psi.

As indicated, the restrictor plate 10 can be positioned reward of the inlet 12 by a distance which allows clear access to the grate 36. For example, the grate rear edge 48 is rearward by about a half of one foot from the inlet 12. Accordingly, the restrictor plate 10 is similarly located to allow access to and removal of the grate 36 after the restrictor plate 10 is installed.

The illustrated restrictor plate 10 substantially as wide as the basin grate 36, which is less than a half of the width of the illustrated basin inlet 12. The height of the restrictor plate 10 is slightly less than the height of the basin inlet 12. For example, in the illustration, the restrictor plate 10 has a height of about four and a half inches, which is about one half of an inch less than the height of the inlet 12.

The height difference between the restrictor plate 10 and the inlet 12 enables floating the restrictor plate 10 above the bottom surface of the catch basin upon installation. Floating enables the restrictor plate 10 to fit within the basin throat 22, despite random surface contour variations. It also allows small particles to pass under the restrictor plate 10 and into the drain 30, which is acceptable by regulations.

The restrictor plate 10 includes a main body 52, which has a bottom edge 54. Attached to the bottom edge 54 is a stiffening flange 56. The flange 56 is pitched downwardly to match the pitch of the basin throat 22. This pitch provide an effective guide for proper insertion of the restrictor plate 10 into the basin throat 22. The flange 52, as illustrated, is about three inches deep. However, other depths which provide the proper stiffness are acceptable.

Regarding the guide function, if a job-site worker accidentally inverts the restrictor plate 10, (e.g., flips the plate 10 about its center, depth-wise axis), the flange pitch will extend in the wrong direction. This would prevent the restrictor plate 10 from being installed in the basin throat 22. The job-site worker would be required to flip the restrictor plate 10 to the proper orientation to complete instillation.

The flange 56 has opposing side edges 58, 60 which are cut or formed with a surface contour. This contour matches the inward pitch angle of the side surfaces 32, 34 of the basin throat 12. This also enables a proper placement of the restrictor plate 10 within the basin throat 12.

Along an upper edge 62 of the restrictor plate 10 are plural flanges 64, 66, which have the same depth as the bottom flange 56. The upper flanges 64, 66 are also parallel with the bottom flange 56. The upper flanges 64, 66 are illustrated as being substantially less than the length of the restrictor plate 10. The flanges 64, 66 provide additional stiffness in the area at which the securing system (discussed below) interacts with the restrictor plate 10. As illustrated, the upper flanges 64, 66 are asymmetrical about their depth-wise centerline and the width of the flanges 64, 66 is approximately five inches.

Figure 3:
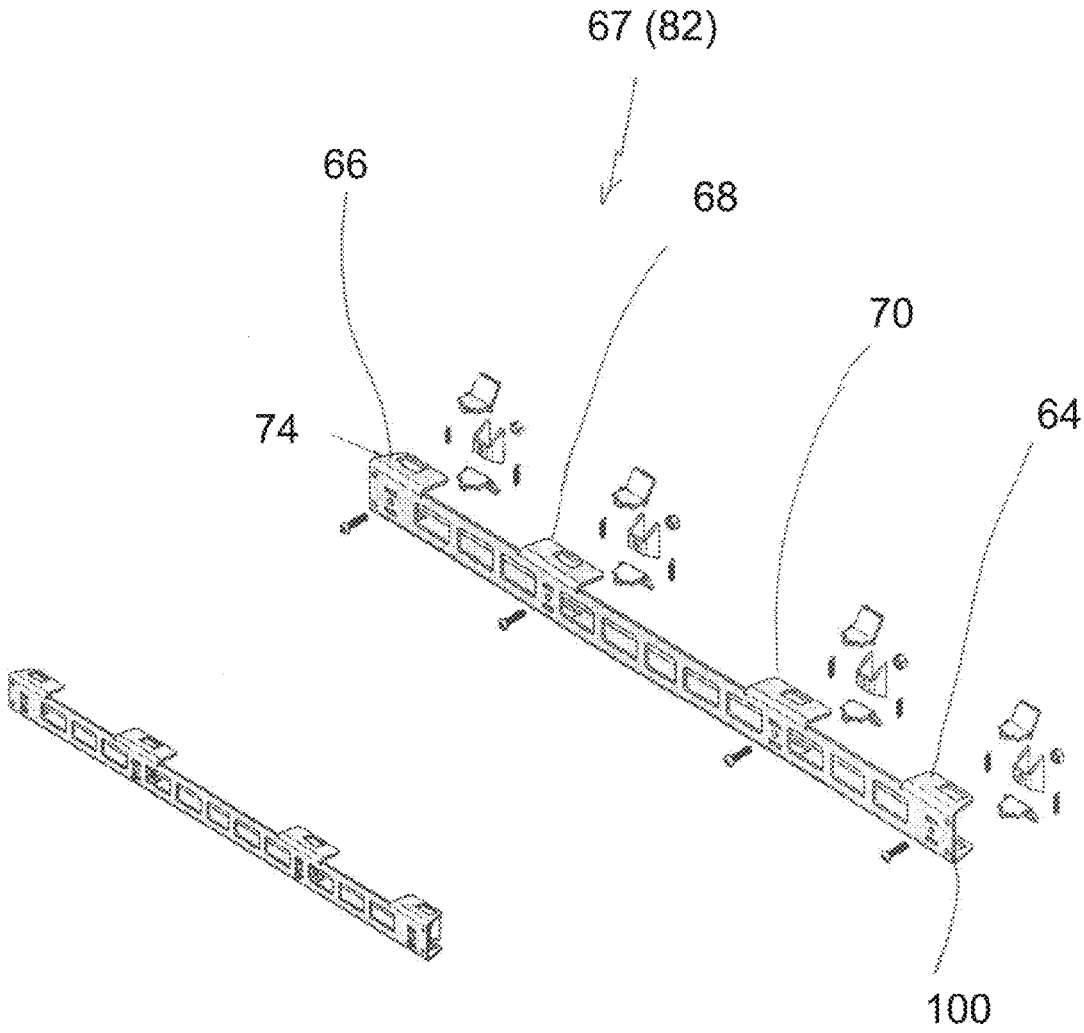
FIG. 3 illustrates details of a second restrictor plate provided in FIG. 1.

Alternatively, if the restrictor plate 10 were longer than that illustrated in FIG. 2, additional securing system (discussed below) could be used for securing the restrictor plate 10 to the basin throat 22. Such a longer restrictor plate 67 is illustrated in FIG. 3, and is provided with flanges 68, 70 which are offset from the center of the restrictor plate 67. The flanges 68, 70 are symmetrical about their depth-wise center and are approximately six inches wide. The actual dimensions of each of the upper flanges 64-70 can be modified so long as structural integrity of the restrictor plates 10, 67 are maintained.

Furthermore, the asymmetric upper flanges 64, 68 have side edges 72, 74, which have the same edge contours as the outer edges 58, 68 of the bottom flange 56. The contours serve the same purpose as with the bottom flange, to guide the restrictor plate 10 when being set in a with-wise tapered basin throat 22.

The restrictor plate 10 has plural drainage openings, e.g., 76, disposed along its length, which allow for continued drainage while restricting larger floatables. Based on design requirements, the size and shape of the openings is less than seven square inches and has a clear space no greater than two inches across the smallest dimension. It is to be noted that the design requirements for the opening size are identified for illustration purposes only and not to limit the scope of the invention.

According to FIG. 2, there are nine openings 76. While eight of the openings are identical, the center opening 78 sized differently and is designed to display a stainless steel badge 80 (FIG. 1), which has been stitch-welded to a rear face 81 of the main body 52 of the restrictor plate 10. The badge 80 can be used to provide information, such as from a government or private entity which installed, or cause to be installed, the restrictor plate 10. For example, the message could be from the U.S.E.P.A. It is to be noted that other shapes, sizes and locations for the badge can be implemented.

As illustrated in FIG. 1, a second restrictor plate 82 is positioned on the right side of the other (first) restrictor plate 10. Depending on the width of the inlet 12 on the right side of the basin grate 36, the second restrictor plate 82 may be shorter, longer or the same length as the first restrictor plate 10. As indicated above, an example of a longer restrictor plate 82 is restrictor plate 67, illustrated in FIG. 3.

It should be appreciated from the above discussion that the shape of the restrictor plates are symmetrically designed. This symmetry provides advantages, discussed below.

The second restrictor plate 82 is positioned forward of the first restrictor plate 10, and is substantially flush with the inlet 12. This is because the second restrictor plate 82 does not extend over the grate 36.

The Splice Plate

The aggregate length of the first and second restrictor plates 10, 82 are intentionally less than the width of the inlet 12. This enables the two restrictor plates 10, 82 to be connected by a splice plate 84, providing end-to-end restricted coverage of the inlet 12.

Figure 4:
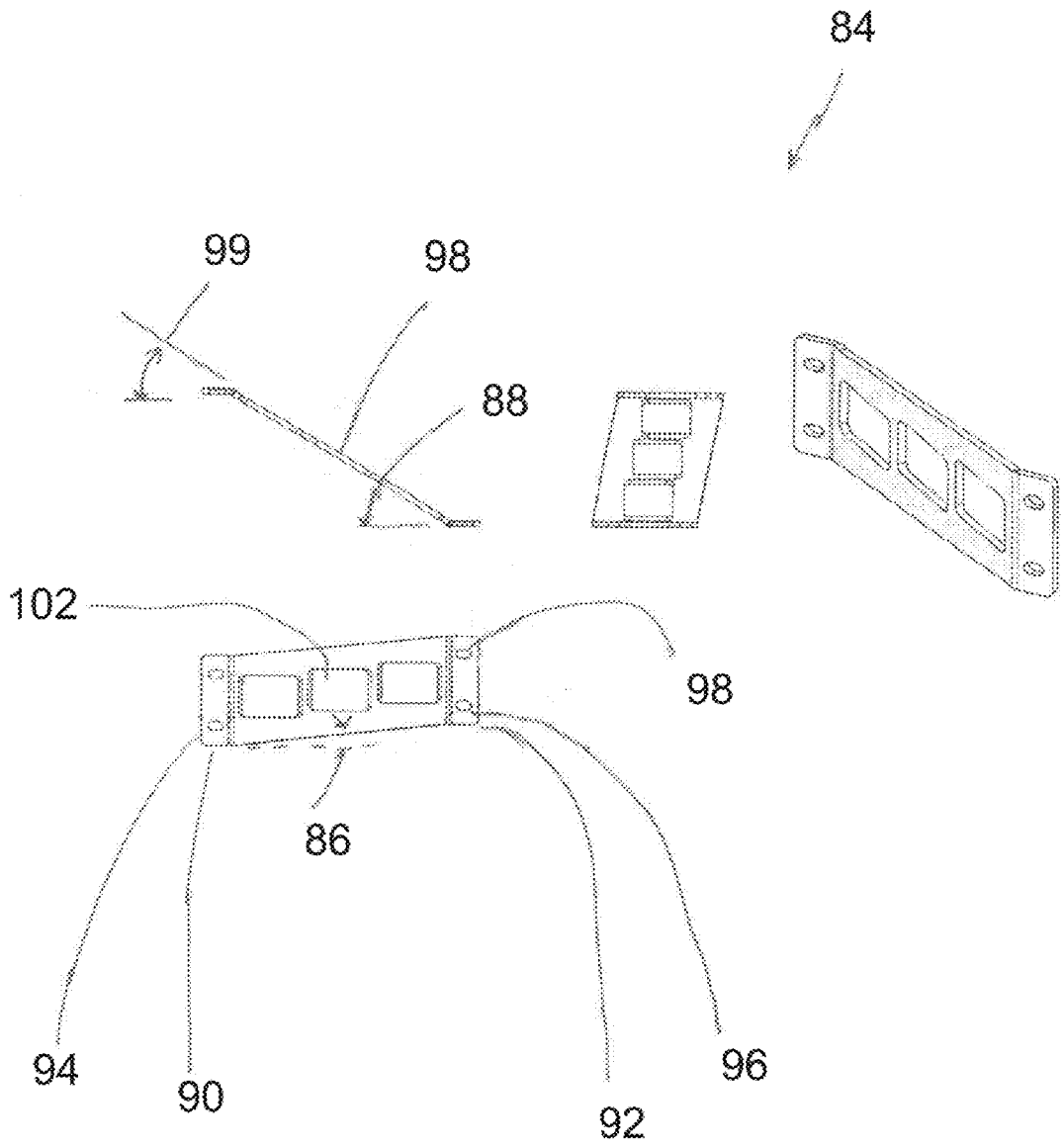
FIG. 4 illustrates details of a splice plate provided in FIG. 1.

The splice plate 84 is formed from the same material as the restrictor plate 10. As illustrated in FIG. 4, the splice plate 84 has the same height as the restrictor plate 10. The splice 84 plate is formed with compound (i.e., two) offset angles 86, 88, such as a shifted slide.

As illustrated in FIG. 4, based on the first offset angle 86, one side 90 of the splice plate 84 is lower than the other side 92. Based on the second offset angle 88, one side 90 of the splice plate terminates rearward of the other side 92. This compound offset matches the downward pitch of the throat 22 occupied between adjacent restrictor plates 10, 82. As a result, the two restrictor plates 10, 82 engage in a linear connection, across the inlet 12.

The splice plate 86 is formed with opposing end tabs 94, 96. The tabs are parallel with each other and at an angle 99 to a main body portion 98 of the splice plate 86. This relationship enables the tabs 94, 96 to be plumb against the main body portions (e.g., 52) of adjacent restrictor plates 10, 82.

The splice plate tabs 94, 96, and connecting ends of at least one of the restrictor plates 10, 82 have plural mounting holes 98, 100. More than one hole in each member is desirable, and two holes are illustrated, to prevent rotation of the splice plate 84 relative to the restrictor plate 82. The type of bolts which can be used to match the splice plates to the restrictor plates include, e.g., ½-13 button head cap screw made of 10-18 steel which conforms with ASTM F835 standards. However, other such mounting bolts may be applied.

The splice plate 86 includes plural drain holes, e.g., 102, which are the same shape as the holes 76 in the restrictor plates 10, 82. The drain holes 102 are stepped in the direction of the first angle 86 of the compound offset of the splice plate 84. Stepping the drain holes in this fashion positions the holes in parallel with the holes 76 in the restrictor plate.

Figure 5:
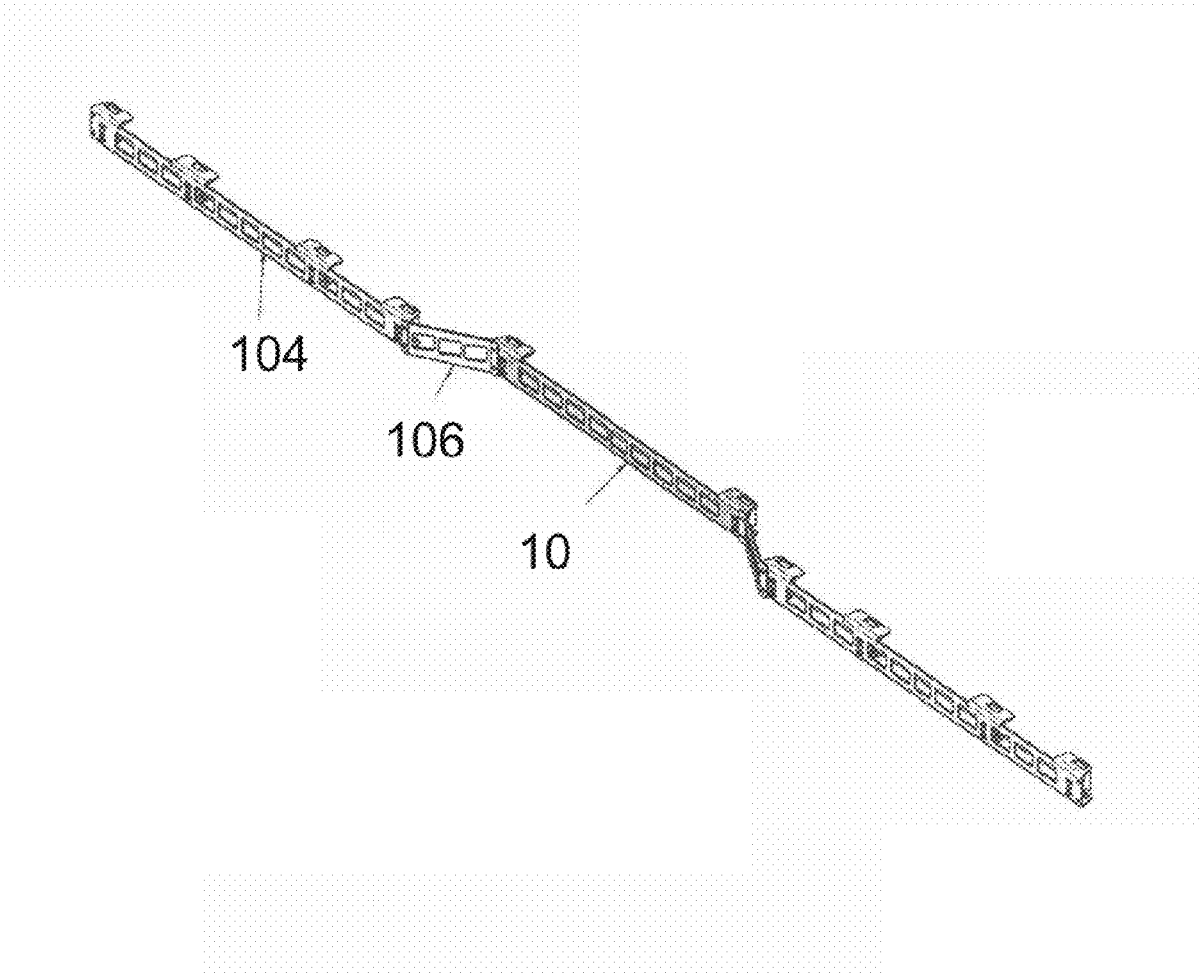
FIG. 5 illustrates an alternative embodiment, utilizing three restrictor plates.

Turning to FIG. 5, another configuration is illustrated. In this configuration, the grate plate (not illustrated) is positioned in the center of a catch basin (not illustrated). In this embodiment, a third restrictor plate 104 can be utilized, along with a second splice plate 106. In this configuration, the outer restrictor plates are flush with the basin inlet. The center restrictor plate is recessed, down the throat of the basin, to allow for grate access.

As illustrated in FIG. 5, the outer restrictor plates are longer than the center restrictor plate. This is suitable for a catch basin in which the center grate is smaller than one/third the width of the basin inlet.

The symmetric shape of each discussed restrictor plate allows the plate to be laterally shifted in the inlet opening. As such, in FIG. 5, the same restrictor plate formation can be used for each outer restrictor plate. The same restrictor plate formation could also serve as the outer plates and the center plate, if conditions warranted such a configuration.

The same formation for the splice plate can provide both splice plates 84, 106. A splice plate needs only be flipped about its axis to suit its purpose.

The Clamp Arm of the Securing System

Figure 6:
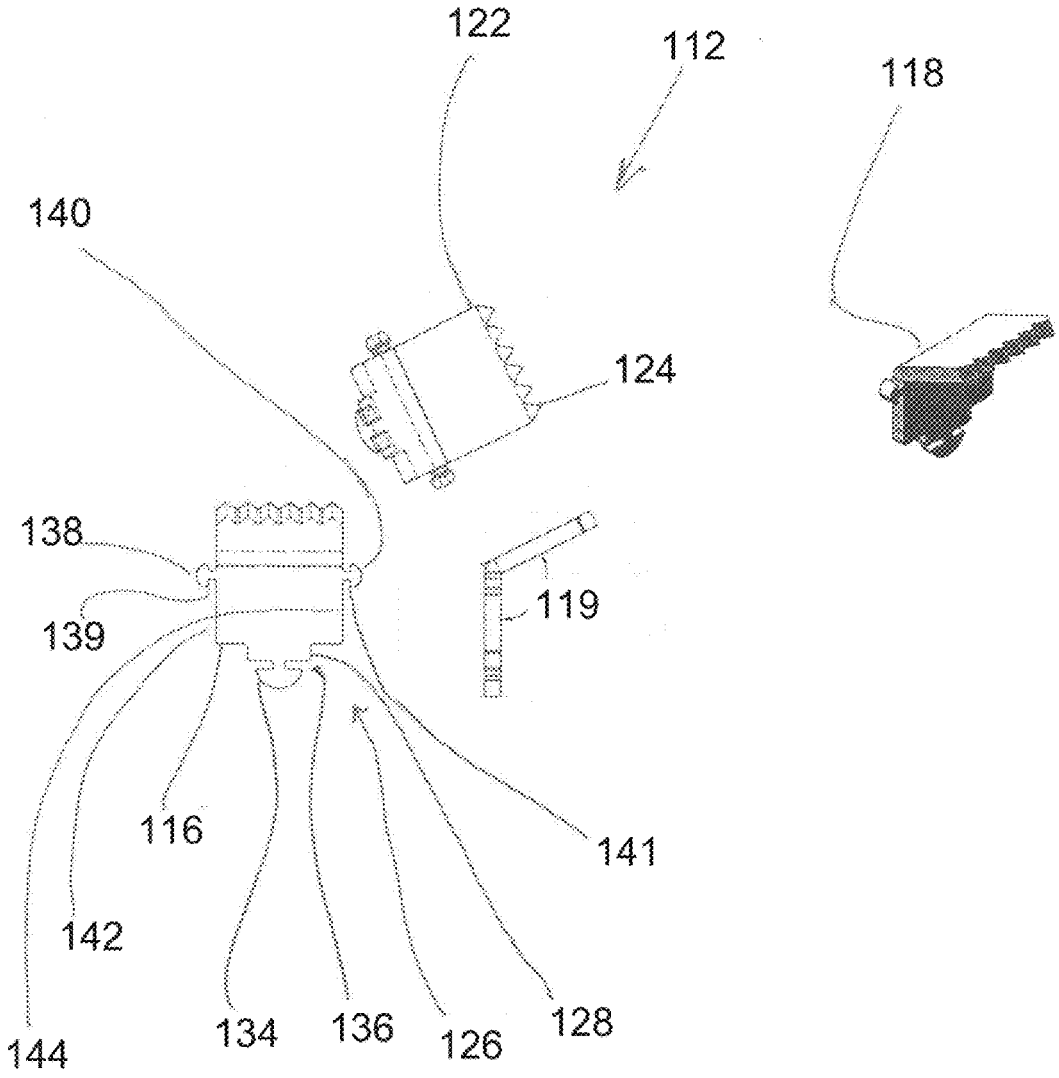
FIG. 6 illustrates details of a clamp arm provided in FIG. 2.
Figure 7:
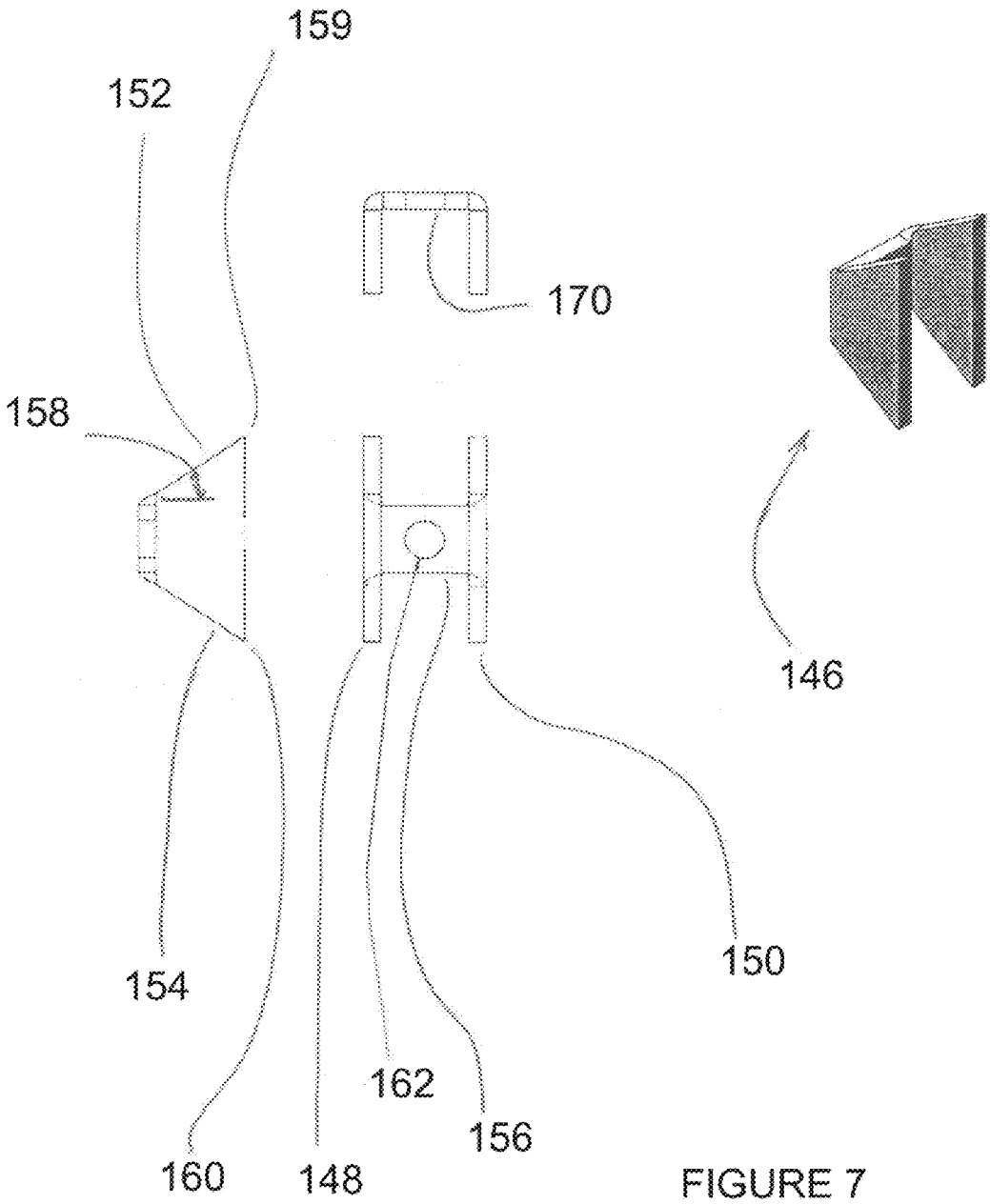
FIG. 7 illustrates details of a wedge provided in FIG. 2.

Attention will now be directed to structure for securing the restrictor plate within the throat of the catch basin, which is illustrated in FIGS. 2, 6 and 7. There are at least two such structures 108, 110, one at each opposing end of the restrictor plate 10. With reference to FIG. 3, more such structures, e.g., a total of four structures, can be added depending on the length of the restrictor plate.

The components of each of the securing systems 108 are identical. Each includes plural clamp arms 112, 114. That is, a lower clamp arm and an upper clamp arm.

A front edge 116 of the lower clamp 112 arm extends outwardly from a rear face 81 of the main body 52 of the restrictor plate 10. A fulcrum 118 is located at about the lengthwise midpoint of the clamp arm 112, at which point the arm pitches downwardly, at an angle 119, which is illustrated as being about sixty degrees. The angle 119 enables the clamp arm 112 to grip into the concrete surface of the basin throat 22, but other angles may be substituted.

Rearward of the fulcrum 118, the clamp extends through an opening 120 in the bottom flange 56. The opening 120 is required due to the depth of the flanges and the size of the clamp arms. The opening 120 in the flange is illustrated as being just over two inches long (i.e., parallel to the length axis for the flange 56) and just over an inch in depth. Furthermore, the opening 120 is spaced by about a quarter of an inch from the depth-wise edge of the flange. However, these dimensions are only exemplarily and can be modified according to the design and placement of the clamp arms.

The upper clamp 114 arm also extends from the rear face 81 of the main body 52 of the restrictor plate 10. The upper clamp 114 extends through an opening 121, sized similarly to the other referenced opening 120, in a respective upper flange 64.

Each clamp arm includes a serrated end section 122. The serrated sections are adapted to dig into the concrete basin throat 22, securing the restrictor plate 10 to the basin. The serrated sections 122 are illustrated as being triangular, saw toothed serrations 124, spanning the distance of the clamp edge. Further, as illustrated, each tooth is about a quarter of an inch tall and about a third of an inch wide. However, other serration configurations may be equally applicable.

In an unbent state, e.g., during the fabrication process, the clamp is illustrated as having a length of about four inches. The clamp is also illustrated as having a width of about two inches. However, these dimensions are not viewed as limiting the invention.

Each clamp has a compound tab 126 disposed at the front clamp edge 116. A rearward part 128 of the tab 126 extends from the center of the front clamp edge 116. The rearward part 128 of the tab 126 projects outwardly from the front clamp edge 116 by the thickness of the restrictor plate 10. The tab 126 is designed to fit within a complementary positioning slot 132 in the restrictor plate 10.

Extending from the rearward portion of the tab 126 is a half-moon shaped secondary tab 134. The secondary tab 134 is connected to the rearward portion 128 of the 126 tab by a narrow connecting extension 136.

With the compound tab 126 and matching slot 132, the clamp 112 can be held in a proper configuration against the restrictor plate 10 before instillation is complete. This is done by inserting the tab 126 into the restrictor plate 10, griping the secondary tab 134 with a wrench, and twisting about the narrow extension 136 by just a few degrees. After instillation is complete, the secondary tab 126 can be torn off by further twisting until the extension 136 factures.

The clamp 112 also has two side edge tabs 138, 140, with associated extensions 139, 141. This structure is similar in shape, though smaller, than the secondary tab 134 and connecting extension 136 in the compound tab 126. The side edge tabs 138, 140 are connected via extensions 139, 141 directly to respective side edges 142, 144 of the clamp 112, forward of the fulcrum 118.

When the long axis of the restrictor plate is parallel with the horizontal, the positioned clamps 112, 114 have two pair of vertically aligned side edge tabs. Each pair is joined by a respective stabilizing spring 142, 144, which helps prevent misalignment of the clamps during instillation.

The Wedge of the Securing System

A wedge 146 is illustrated in FIG. 7, which has opposing wedge surfaces 148, 150. Each of the surfaces 148, 150 is double sided 152, 154, and each extends substantially perpendicular to an intermediate surface 156. The pitch angle 158 for each side 152, 154 of the wedge 146 is about forty degrees, but other suitable angles could be utilized. The wedge is fabricated from the same material as the restrictor plate 10.

In use, the intermediate wedge surface 156 is pulled towards the rear face 81 of the main body 52 of the restrictor plate 10. By this operation, the opposing pitched surfaces 152, 154 of the wedge 146 press against the clamp arms at, e.g., the fulcrum. The clamp arms are thereby advanced through respective upper and lower flange openings and forced to dig into the concrete in the basin throat 22.

The intermediate wedge surface 156 is widthwise dimensioned to separate the wedge surfaces 148, 150 against the clamp arm 112 by substantially the width of the clamp arm. The intermediate wedge surface 156 is height-wise dimensioned to separate opposing, outermost tips 159, 160 of the wedge by about three inches, but other height-wise spacing may be substituted.

The intermediate surface is drawn to the restrictor plate, via a through hole 162, by a mounting bolt 164. As illustrated, the mounting bolt 164 is a ½-13 button head cap screw made of 10-18 steel which conforms with ASTM F835 standards. However, other such mounting bolts may be applied. The head of the bolt 166 rests against the front surface 168 of the main body 52 of the restrictor plate 10. On the other side, a mounting nut 165 is positioned on a rear surface 170 of the intermediate surface 156.

In use, the wedge is positioned against the clamp arms, which are urged together by the springs. The mounting bolt and nut are introduced and tightened by, e.g., 72+5−0 ft-lbs of torque. This causes the wedge to urge the clamp arms against the concrete basin, thereby centering the restrictor plate in the height of the opening. This also renders the system tamperproof at the completion of instillation. The secondary tabs can be removed, as indicated above, as may be required or desired.

The present invention may be embodied in other specific forms without departing from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within the meaning and range of equivalency of the claims are to be embraced within their scope.

I claim:

1. A restrictor plate assembly, adapted for being positioned within a catch basin throat such that the throat extends rearward from said assembly, said assembly comprising:

a longitudinally extending restrictor plate;

a restrictor plate securing system, comprising:

(a) a first clamp arm, pivotally positioned against said restrictor plate, for engaging a first throat surface of said catch basin;

(b) a second clamp arm, pivotally positioned against said restrictor plate, for engaging a second throat surface of said catch basin, said second throat surface opposing said first throat surface; and (c) an urging member which simultaneously urges said first and second clamp arms against said first and second throat surfaces, respectively.

2. The assembly of claim 1, wherein:

said clamp arms contain pitched segments which, when said clamp arms are installed in said restrictor plate, pitch away from each other.

3. The assembly of claim 2, wherein said clamp arms contain a fulcrum and said pitched segments which, when said clamp arms are installed in said restrictor plate, are rearward of said fulcrum.

4. The assembly of claim 3, wherein:

said urging member is a wedge, defined by at least one wedge member having opposing pitched surfaces; and said wedge is capable of being pulled toward said restrictor plate, whereby said clamps engage said basin throat.

5. The assembly of claim 4, wherein said pitched segments define approximately a half a length of said clamp arms.

6. The assembly of claim 4, wherein said itched segments include a serrated edge for gripping the basin throat upon installation of said restrictor plate in said basin throat.

7. The assembly of claim 4, wherein said wedge includes plural wedge members spaced by an intermediate member, wherein said intermediate member is capable of being pulled toward said restrictor plate.

8. The assembly of claim 7, wherein said plural wedge members are parallel to each other and have substantially the same shape.

9. The assembly of claim 8, wherein plural wedge members are spaced by a distance which corresponds to a width of said clamp arms.

10. The assembly of claim 9, including a bolt for pulling said intermediate, member against said restrictor plate.

11. The assembly of claim 10, wherein said clamp arms include alignment tabs and said restrictor plate includes tab openings for receiving said tabs.

12. The assembly of claim 11, wherein said clamp arms include secondary tabs which are adapted for positioning said clamps against said restrictor plate when said wedge is not installed.

13. The assembly of claim 12, wherein said alignment tabs are compound tabs which include said secondary tabs extending therefrom.

14. The assembly of claim 13, wherein said clamp arms include side edge tabs, and biasing members connecting said opposing clamp arms via said side edge tabs, whereby said clamp arms are biased towards each other.

15. The assembly of claim 14, wherein said biasing members are springs.

16. The assembly of claim 4 wherein a height of said restrictor plate is less than a height of the throat, and said restrictor plate securing system height-wise centers said restrictor plate in said throat.

17. The assembly of claim 4, wherein said restrictor plate includes at least one drain opening for limiting a size of floatables passing therethrough.

18. The assembly of claim 4, including a stiffening flange extending along a first or second lengthwise edge of said restrictor plate.

19. The assembly of claim 18, wherein said basin throat pitches in a first direction and said flange has a corresponding pitch relative to said restrictor plate.

20. The assembly of claim 19, in said basin throat tapers widthwise and said flange has a corresponding taper on opposing flange corners.

21. The assembly of claim 20, wherein:

said restrictor plate is a first restrictor plate; and said assembly includes;

plural pairs of opposing clamp arms; and plural additional stiffening flanges, spaced lengthwise along the other of said first and second edges of said restrictor plate;

each additional flange positioned over a respective pair of said opposing clamp arms.

22. The assembly of claim 21, wherein said flanges include clamp openings through which said clamp arms extend.

23. The assembly of claim 22, wherein said restrictor plates are symmetric.

24. The assembly of claim 23, comprising plural restrictor plates, positioned lengthwise adjacent to each other in said basin throat, at least two of said restrictor plates being depth-wise offset from each other and height-wise offset from each other from the pitch angle of the basin threat.

25. The assembly of claim 24, including a splice member, adapted for connecting adjacent restrictor plates.

26. The assembly of claim 25, wherein said splice member comprises a compound offset for connecting adjacent restrictor plates which are depth-wise offset and height-wise offset.

27. The assembly of claim 26, wherein the splice plate includes at least one drain opening having the same size and shape of the at least one restrictor plate drain opening.

28. The assembly of claim 27, wherein the splice plate includes plural drain openings stepped relative to each other, whereby the splice plate holes are parallel with the at least restrictor plate drain opening.

* * * * *